United States Patent [19]

Hu

[11] Patent Number: 5,016,616

[45] Date of Patent: May 21, 1991

[54] PLASTIC HEALTH MASSAGE DISK

[76] Inventor: Chen Hu, Taipei, Taiwan

[21] Appl. No.: 383,747

[22] Filed: Jul. 24, 1989

[51] Int. Cl.[5] ..... A61H 1/00

[52] U.S. Cl. ..... 128/32; 128/36; 128/68.1

[58] Field of Search ..... 128/32, 36, 34, 35, 128/24 R, 24.1, 68.1

[56] References Cited

U.S. PATENT DOCUMENTS

| | | | |
|---|---|---|---|
| 881,321 | 3/1908 | Kellogg | 128/32 X |
| 4,343,303 | 8/1982 | Williams | 128/32 |

*Primary Examiner*—Edgar S. Burr
*Assistant Examiner*—Moshe I. Cohen
*Attorney, Agent, or Firm*—Notaro & Michalos

[57] ABSTRACT

A flexible plastic massage disk comprises a filled sack containing a vibration motor, with wires, power supply switch and power supply box connected thereto. The vibration motor is installed in the sack and the wires extend through the wall of the sack to the power supply switch which is connected to the power supply box. The sack is filled with plastic by deformable material for allowing the sack to take on the curvature at different places on the human body for a complete match to the part of the human body that requires massage. Once the power is turned on, oscillations will result from the vibration motor in the sack, and travel through the plastic material to soften such vibrations and transmit them to the entire sack. The user can enjoy a larger area of stimulation and feels a soft comfortable oscillation massage effect, particularly for those people reaching above middle age, to offer a more proper and long duration massage so as to provide an excellent fatigue stopping, beautifying and health promoting circulation to a particular part (such as the testicles) of the human body.

4 Claims, 2 Drawing Sheets

PLASTIC HEALTH MASSAGE DISK

BACKGROUND OF THE INVENTION

1. Field of the Invention

This invention relates to a plastic massage disk comprising a sack filled with plasticly deformable material and in the form of a disk shape. A vibration motor is contained in the sack and wires lead from the vibration motor to a power switch and a power supply box connected to the wire terminals. The plastic material filled in the sack achieves a wider area of contact having proper curvature to engage parts of the human body. The vibration produced from the motor within has a softened effect with the transmission through the plastic material. This massaging effect promises an easy, calming vibration, thus providing a confortable, long-time application for people, particularly those reaching their middle age and above, with excellent effectiveness in eliminating fatigue, beautifying and massaging particular parts of the human body.

DESCRIPTION OF THE PRIOR ART

Commonly available vibrators generally are hard in construction with a given shape while only massaging a given point or small area of the human body. The vibration transmitted by the vibration motor within is always rather strong and direct. As a consequence, the part of human body to receive the massage is very limited in area and the effect achieved can not be termed satisfactory. Furthermore, the users will find it difficult to maintain a long period of application since such vibration is so hard and direct. In addition, it is always required for the user to spare one hand to hold the prior art vibrator during the application that easily develops sour and tired hands in case of long time use. Thus it can not be termed convenient. To a male, the testicles are a very peculiar organ that produces the sperm and gonadotropin. Sperm is for the reproductive purpose while the gonadotropin constitutes the major factor that makes a man a man. Therefore, the testicle deserve health development to maintain it in strong status, however, the traditional way of sports of the enforce the health to human body is prevented since the testicles are the only organ deprived of self controlled movement, thus is vulnerable to deterioration.

Man, when reaching middle age, always find that his testicles experience shrinkage, leading to a set back of his sexual activity that more often is mistaken by him as a problem of incompetence and is felt as a great pain. The piror art yields a hard and violent vibration, certainly not recommendable and applicable to massage such a limited area as the testicles.

SUMMARY OF THE INVENTION

Accordingly, the chief object of the present invention is to provide an improving method against the generally available vibrator, for massaging particular parts of the human body, particularly the aforesaid testicles, as this inventor has personally experienced such a painful process of deterioration and read many medical texts covering sexual physical subjects and eventually found that the testicles are the crucial part. Basing on such recognition, this inventor has initiated a series of uninterrupted tests and improvements to successfully complete this invention. The plastic health massage disk, by taking advantage of the sack that allows proper curvature, wider area of contact with the human body and soft, soothing vibration to be able to adapt to any part (that, of course, including the fragile testicles) of the human body. After a personal trial application of this invention for six months, this inventor found an excellent achievement in developing strong testicles, and improved significantly his sexual performance. In addition, this invention is applicable to any part of the human body for yielding a soft, easy, and confortable massage for both sexes, particularly for those middle aged and the aged; furthermore, it allows a long lasting soothing massage, completely removed all the shortcomings that are so evident in the prior art of this invention.

Another object of the present invention is to provide a massage sack that allows the best efficient and the maximum close contact by conforming to the curvature of the human body, so as to avail a sufficient and excellent massage effect from this plastic health massage disk.

BRIEF DESCRIPTION OF THE DRAWINGS

The present invention will become more readily apparent from the following description of the preferred embodiment of the present invention taken in conjunction with the accompanying drawing, in which.

DETAILED DESCRIPTION OF THE PREFERRED EMBODIMENT

Figure 1:
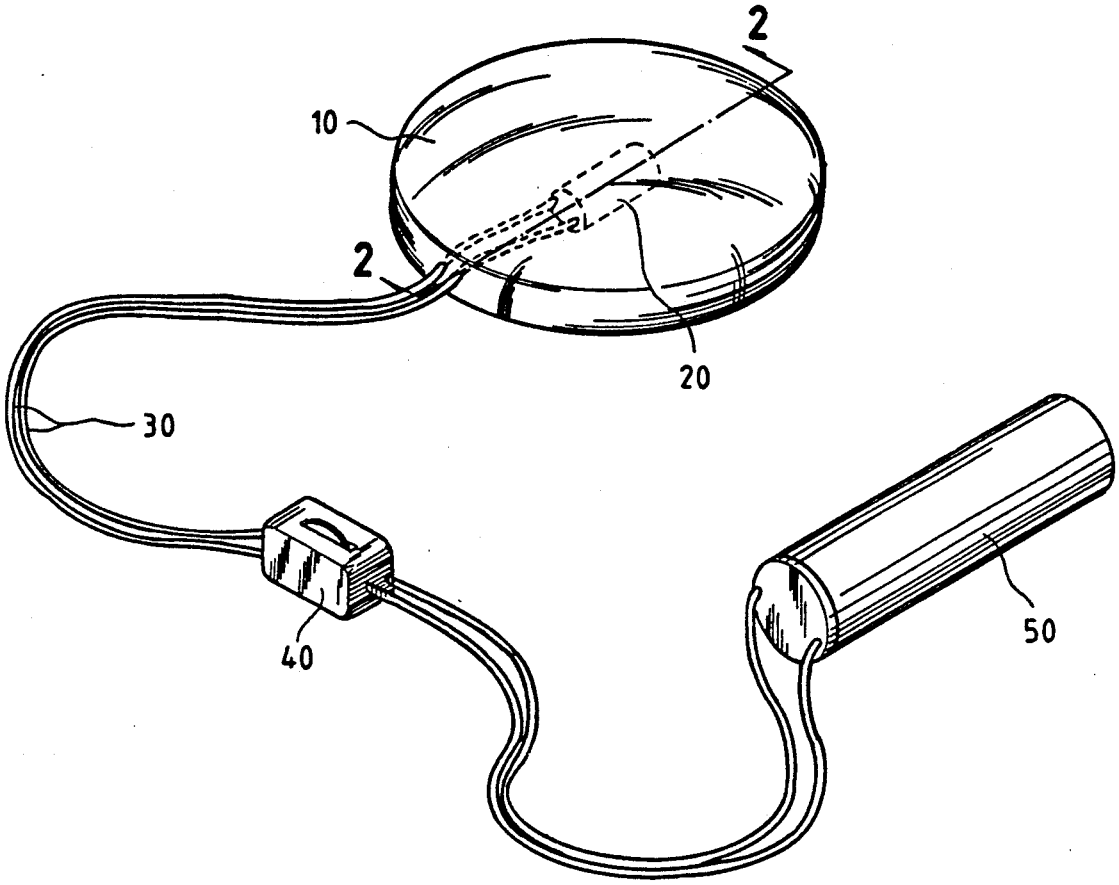
FIG. 1 is a perspective view showing the present invention.
Figure 2:
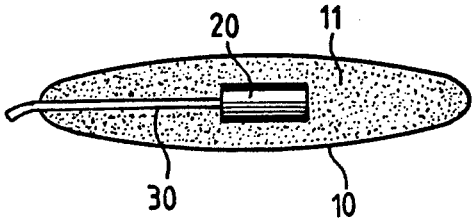
FIG. 2 a sectional view taken along the line 2—2 in FIG. 1.

FIGS. 1 and 2 of the accompanying drawing illustrate this invention as comprising a sack 10, a vibration motor 20, conductive wires 30, a power switch 40 and a power supply box 50. Sack 10, which is roughly in the shape of a disk, is filled with plastic material 11, such as PVC powder, earth, and white wax (cire blanche), which is blended with linseed oil.

The manufacturing process of the invention is as follows: well ground PVC grains are baked dry, then the resulted powder is screened for proper grain size. The same process is applied also to the earth which is to be blended with PVC powder. On the other hand, white wax is heated to the melting point and the linseed oil is also heated to the same temperature before being mixed with the white wax.

Finally, the mixture of PVC powder and earth powder as well as the mixture of white wax and linseed oil are blended and evently distributed into a semi-solid state to form the plastic material 11, which is then applied to clad the vibration motor 12 prior to its being coated with a layer of PVC film(similar to those marketed films for food preservation) to seal the mixture and form the sack 10. The plastic material 11 can be bent and shaped at random without getting dried. A.D.C. 3V motor is recommended for the vibration motor 20 of the invention, which is installed in the sack 10 and subject to be clad by plastic material 11. Wires 30 leading out from the vibration motor 20 and through the sack 10, carry a power switch 40, properly attached to the circuit, while the terminals of the wires are connected to a power supply box 50. Once switch 40 is turned on, the power supplied from power supply 50 through wires 30 activate the vibration motor 20 to produce vibration within sack 10, such vibration then is properly absorbed by the plastic soft material 11 and gently transmit to the whole body of sack 10 forming a completely different effect from the traditional vibrator which causing "hard and stiff" massage effects and displaying a soft and confortable vibration state, more particularly applicable for the user at any age and in either sex or on such special parts of the human body as the testicles, scalp and face, also allowing a long time operation.

Figure 3:
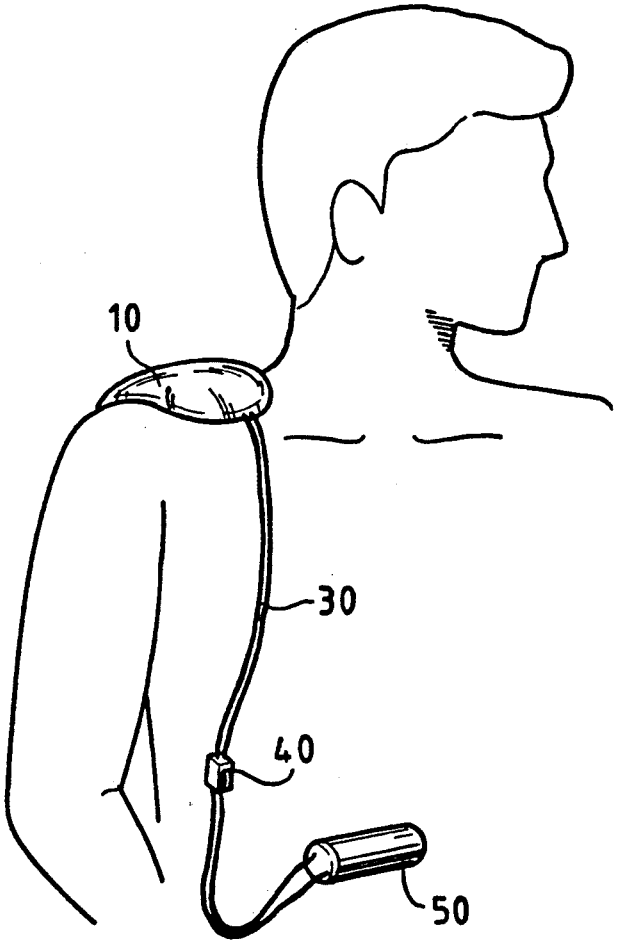
FIG. 3 is the preferred embodiment of the present invention.

By virture of the aforesaid structure and in case one desires to massage his shoulders with the present invention, FIG. 3 shows the sack 10 bent to match the curvature of the shoulder and placed where it will not fall off easily since the curvatures are perfectly matched and the contact area is larger than those smaller areas or point contacts available from the prior art vibrators. When the power supply is connected by switch 40 to activate the vibration motor 20 within the sack 10, vibrations travel through the plastic material 11 within the sack 10 and through the whole body of sack 10 to achieve a very soft and steady massage, and a long operating one. Furthermore, the power supply switch 40 and the power supply box 50 are separate from the exterior of the sack 10, another different feature from the traditional vibrator having all components within the same container, allowing one to carry both power switch 40 and power supply box 50, hidden in one's pockets or in a back pack to let one have both hands free. The hands are thus free for attending to other things if the part to be massaged happens to be on the shoulder, scalp or the legs, abdomen, etc. This too is evidence of the practical use of this present invention.

Furthermore, it is worthwhile to mention that since the entire body of sack 10 allows any bending at random, what's more, the vibration transmitted is of a soft and steady nature that is particularly suitable for massaging the testicles to secure good circulation to such particular parts by enhancing the metabolism and producing much more sperm for creating the gonadotropin, a positive factor to promote a natural, satisfactory and healthy marriage life.

To sum up, the present invention provides a soft and large contact area of easy and steady vibration massage effects with its unique and brand-new structure to invest in better application effectiveness when compared to the conventional vibrator and particular offers the excellent sporting massage performance for access to special parts of the human body.

What is claimed is:

1. A massage disk comprising:

a disk shaped sack filled with plasticly deformable material formed of a mixture of a plurality of materials so that the sack can be bent at random into a multiplicity of contours, to follow the contours of various parts of the human body;

a vibration motor embedded in the plasticly deformable material and positioned inwardly of the outer-surface of the sack so that when the vibration motor is activated, it transmits vibrations through the plasticly deformable material to the outer surface of the sack;

an external power supply;

connecting wires connecting the external power supply to the vibration motor, said wires extending through the outer surface of the sack; and a switch in at least one of the wires for connecting and disconnecting power from the power supply to the vibration motor to activate the motor.

2. A massage disk according to claim 1 wherein the plasticly deformable material includes PVC powder blended with linseed oil.

3. A message disk according to claim 2 wherein the plasticly deformable material includes earth and white wax mixed with the PVC powder and linseed oil.

4. A massage disk according to claim 3 wherein the vibration motor is substantially cylindrical.

* * * * *